US007567034B2

(12) United States Patent
Su et al.

(10) Patent No.: US 7,567,034 B2
(45) **Date of Patent: *Jul. 28, 2009**

(54) PLASMA DISPLAY PANEL WITH DISCHARGE SPACES HAVING SUB-PIXEL UNITS

(75) Inventors: Yao-Ching Su, Tao-Yuan (TW); Shiang-Wen Wan, Taipei-Hsien (TW)

(73) Assignee: AU Optronics Corp., Hsin-Chu (TW)

( * ) Notice: Subject to any disclaimer, the term of this patent is extended or adjusted under 35 U.S.C. 154(b) by 384 days.

This patent is subject to a terminal disclaimer.

(21) Appl. No.: 11/562,429

(22) Filed: Nov. 22, 2006

(65) Prior Publication Data

US 2007/0090761 A1 Apr. 26, 2007

Related U.S. Application Data

(63) Continuation of application No. 10/708,157, filed on Feb. 12, 2004, now Pat. No. 7,170,226.

(30) Foreign Application Priority Data

Aug. 27, 2003 (TW) ..... 092123662

(51) Int. Cl.
*H01J 17/49* (2006.01)

(52) U.S. Cl. ..... 313/582; 313/585; 313/292

(58) Field of Classification Search ..... 313/582, 313/583–585, 292; 345/60, 67
See application file for complete search history.

(56) References Cited

U.S. PATENT DOCUMENTS

| | | | | |
|---|---|---|---|---|
| 5,640,068 | A | 6/1997 | Amemiya | |
| 5,659,226 | A * | 8/1997 | Shigeta | 313/491 |
| 5,825,128 | A | 10/1998 | Betsui et al. | |
| 5,967,872 | A * | 10/1999 | Betsui et al. | 445/24 |
| 6,373,195 | B1 | 4/2002 | Whang et al. | |
| 6,376,986 | B1 | 4/2002 | Takagi et al. | |
| 6,515,420 | B2 | 2/2003 | Chen et al. | |
| 6,784,617 | B2 | 8/2004 | Jeong et al. | |
| 6,870,316 | B2 | 3/2005 | Sano et al. | |
| 7,170,226 | B2 * | 1/2007 | Su et al. | 313/582 |

* cited by examiner

*Primary Examiner*—Karabi Guharay
(74) *Attorney, Agent, or Firm*—Winston Hsu

(57) ABSTRACT

A plasma display panel includes a plurality of first discharge spaces positioned between a front substrate and a rear substrate, and a plurality of sub-pixel units, each of the first discharge spaces having at least two of the sub-pixel units. Each of the first discharge spaces having at least two of the sub-pixel units increases the space available to discharge gas in each sub-pixel unit, thereby reducing a discharge voltage of the discharge gas in each sub-pixel unit and further decreasing an operating voltage and power consumption of the plasma display panel.

8 Claims, 17 Drawing Sheets

PLASMA DISPLAY PANEL WITH DISCHARGE SPACES HAVING SUB-PIXEL UNITS

CROSS REFERENCE TO RELATED APPLICATIONS

This is a continuation application of U.S. patent application Ser. No. 10/708,157 filed Feb. 12, 2004 now U.S. Pat. No. 7,170,126.

BACKGROUND OF THE INVENTION

1. Field of the Invention

The present invention relates to a plasma display panel, and more specifically, to a plasma display panel having a plurality of closed rib units, each of which including at least two sub-pixel units.

2. Description of the Prior Art

A plasma display panel (PDP) is one kind of flat display panels using gas discharges to create brilliant irradiation. Since the PDP has the advantage of a thin and large-scaled design, and low radiation, it is a mainstream large-scaled display panel.

For example, a plasma display panel is disclosed in U.S. Pat. No. 6,373,195 B1 and its detailed structure is described as follows. Please refer to FIG. 1 and FIG. 2. FIG. 1 is an exploded diagram of a plasma display panel disclosed in U.S. Pat. No. 6,373,195 B1. FIG. 2 is a top view of the plasma display panel shown in FIG. 1. As shown in FIG. 1 and FIG. 2, a PDP 10 comprises a front substrate 12, a rear substrate 14 arranged in parallel with and opposite to the front substrate 12, and a discharge gas filled between the front substrate 12 and the rear substrate 14. Additionally, a plurality of X electrodes 16 and a plurality of Y electrodes 18 are formed on the front substrate 12, and a plurality of parallel address electrodes 20 are formed on the rear substrate 14. The X electrodes 16 are arranged in parallel with and interlaced with the Y electrodes 18, and the address electrodes 20 are perpendicular to the X electrodes 16 and the Y electrodes 18. Each of the X electrodes 16 includes a bus electrode 16*a*, a plurality of sustain electrodes 16*b* connected to one side of the bus electrode 16*a*, and a plurality of sustain electrodes 16*c* connected to the other side of the bus electrode 16*a*. Likewise, each of the Y electrodes 18 includes a bus electrode 18*a*, a plurality of sustain electrodes 18*b* connected to one side of the bus electrode 18*a*, and a plurality of sustain electrodes 18*c* connected to the other side of the bus electrode 18*a*. The sustain electrodes 16*b* of each X electrode 16 are opposite to the next sustain electrodes 18*c*, while the sustain electrodes 16*c* of each X electrode 16 are opposite to the next sustain electrodes 18*b*.

As shown in FIG. 1, the PDP 10 further comprises a plurality of parallel ribs 22, and a plurality of ribs 24 connected between two adjacent ribs 22, so that a plurality of sub-pixel units 26, 28 and 30 is defined between the ribs 22 and the ribs 24. Additionally, each of the sub-pixel units 26 is a red sub-pixel unit R that is coated with red phosphors, each of the sub-pixel units 28 is a green sub-pixel unit G that is coated with green phosphors, and each of the sub-pixel units 30 is a blue sub-pixel unit B that is coated with blue phosphors. Furthermore, three sub-pixel units, which are arranged in a delta and include a red sub-pixel unit R, a blue sub-pixel unit B, and a green sub-pixel unit G, constitute a pixel unit.

After the discharge gas in the sub-pixel units 26, 28 and 30 is applied with a discharge voltage, the discharge gas is excited and ionized to produce ultraviolet light. Thereafter, the ultraviolet light irradiates the red, green, and blue phosphors so that the sub-pixel units 26, 28, and 30 can emit red, green, and blue visible light. Additionally, the discharge voltage used to excite and ionize the discharge gas is varied with the space available to the discharge gas, and usually, the discharge voltage becomes smaller if the space available to the discharge gas gets larger. Therefore, an increase in the discharge voltage will reduce power consumption of a PDP. However, since each sub-pixel unit of the PDP 10 is defined between the front substrate 12, the rear substrate 14, two adjacent ribs 22, and two adjacent ribs 24, the space available to the discharge gas in each sub-pixel unit is limited to the space where each sub-pixel unit occupies. As a result, the discharge voltage of the discharge gas in each sub-pixel unit 26, 28, or 30 is much higher, so that an operating voltage of the PDP 10 is high and the power consumption of the PDP 10 is therefore considerable.

SUMMARY OF THE INVENTION

It is therefore a primary objective of the claimed invention to provide a plasma display panel having a plurality of closed rib units, each of which including at least two sub-pixel units, so as to solve the above-mentioned problem.

According to the claimed invention, a plasma display panel is provided. The plasma display panel includes a plurality of first discharge spaces positioned between a front substrate and a rear substrate, and a plurality of sub-pixel units, each of the first discharge spaces comprising at least two of the sub-pixel units.

It is an advantage over the prior art that each of the first discharge spaces of the claimed invention comprises at least two of the sub-pixel units, so that the space available to discharge gas in each sub-pixel unit is increased, thereby reducing a discharge voltage of the discharge gas in each sub-pixel unit and further decreasing an operating voltage and power consumption of the plasma display panel.

These and other objectives of the present invention will no doubt become obvious to those of ordinary skill in the art after reading the following detailed description of the preferred embodiment that is illustrated in the various figures and drawings.

DETAILED DESCRIPTION

Figure 3:
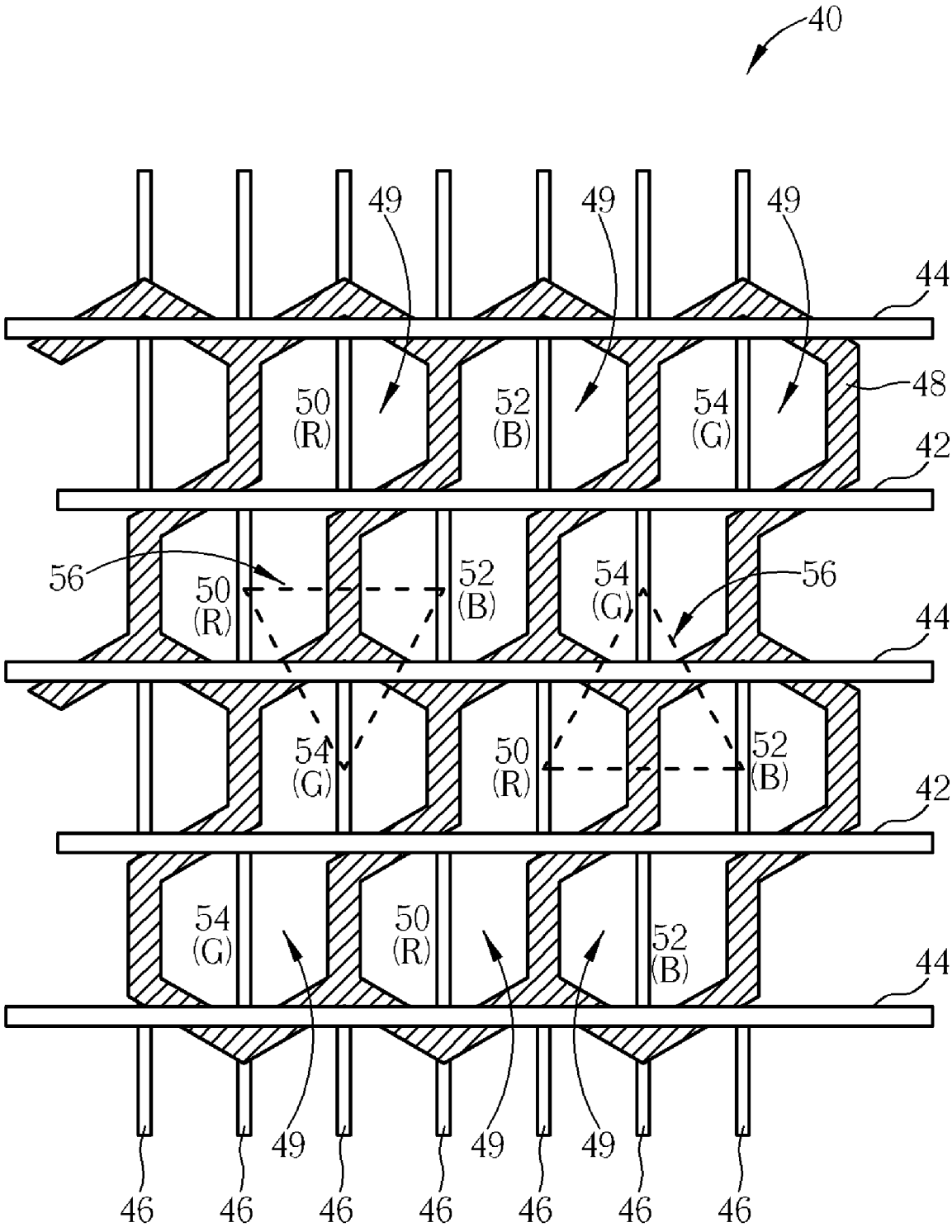
FIG. 3 and FIG. 5 are top views of a plasma display panel according to the first embodiment of the present invention.
Figure 4:
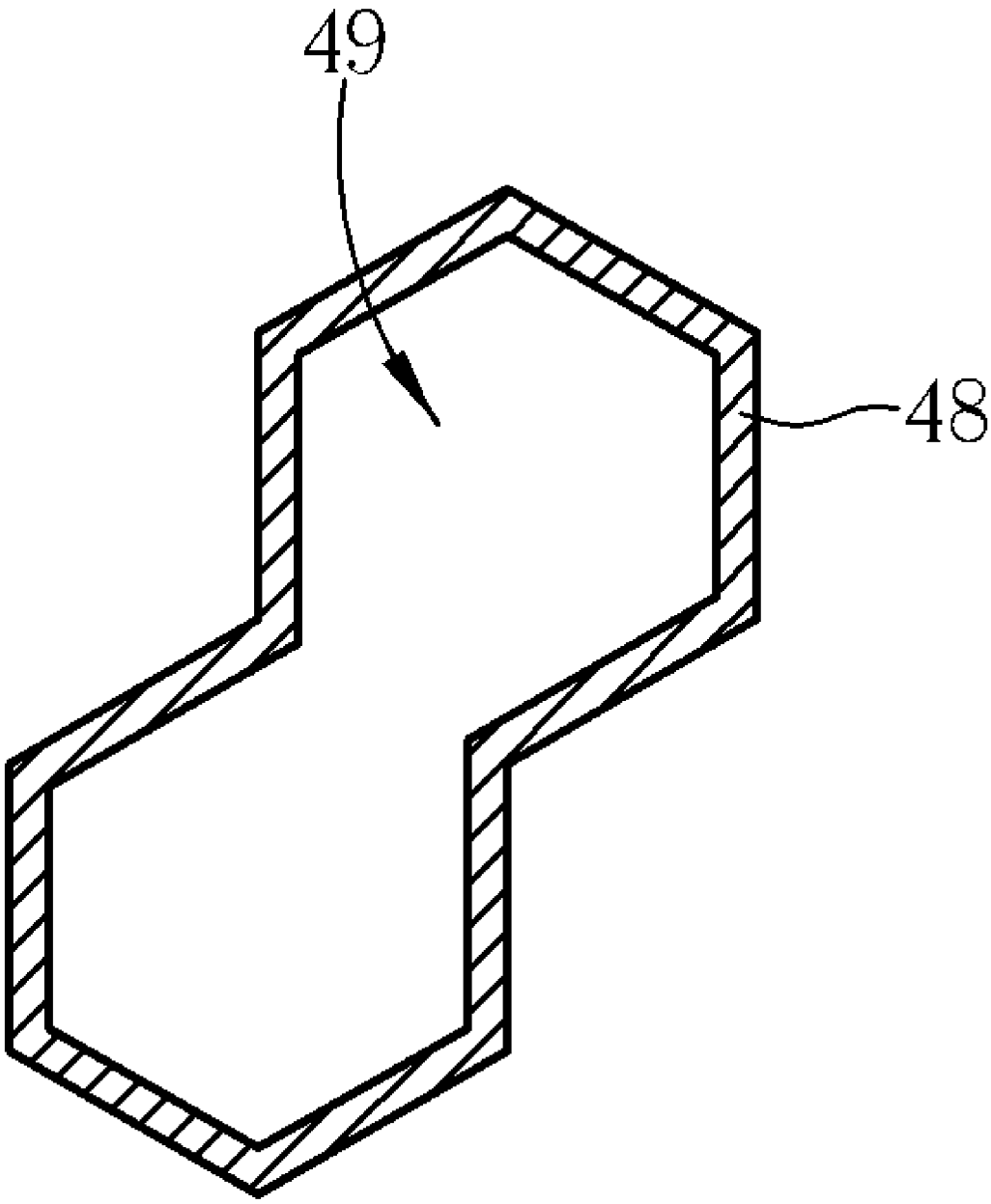
FIG. 4 is a schematic diagram of a closed rib unit shown in FIG. 3.
Figure 5:
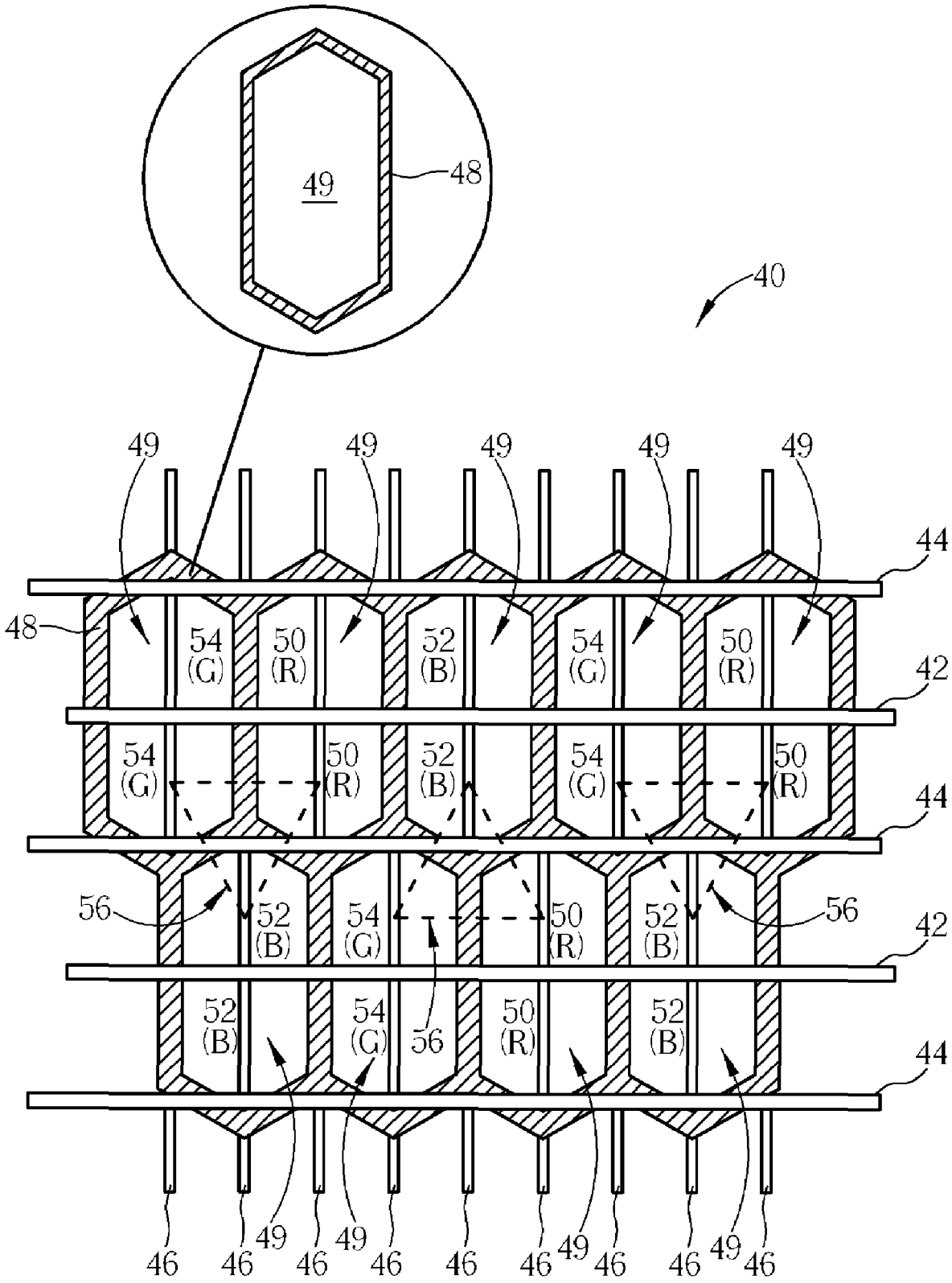

Please refer to FIG. 3 to FIG. 5. FIG. 3 and FIG. 5 are top views of a plasma display panel according to the first embodiment of the present invention. FIG. 4 is a schematic diagram of a closed rib unit shown in FIG. 3. As shown in FIG. 3, a PDP 40 comprises a front substrate (not shown), a rear substrate (not shown) parallel and opposite to the front substrate, and a discharge gas (not shown) filled between the front substrate and the rear substrate. Additionally, the PDP 40 further comprises a plurality of X electrodes 42 formed on the front substrate, a plurality of Y electrodes 44 formed on the front substrate, and a plurality of address electrodes 46 formed on the rear substrate. The X electrodes 42 are arranged in parallel with and interlaced with the Y electrodes 44, and the address electrodes 46 are perpendicular to the X electrodes 42 and the Y electrodes 44. Usually, the X electrodes 42 and the Y electrodes 44 are composed of aluminum (Al), silver (Ag), chromium/copper/chromium (Cr/Cu/Cr), or chromium/aluminum/chromium (Cr/Al/Cr).

Figure 6:
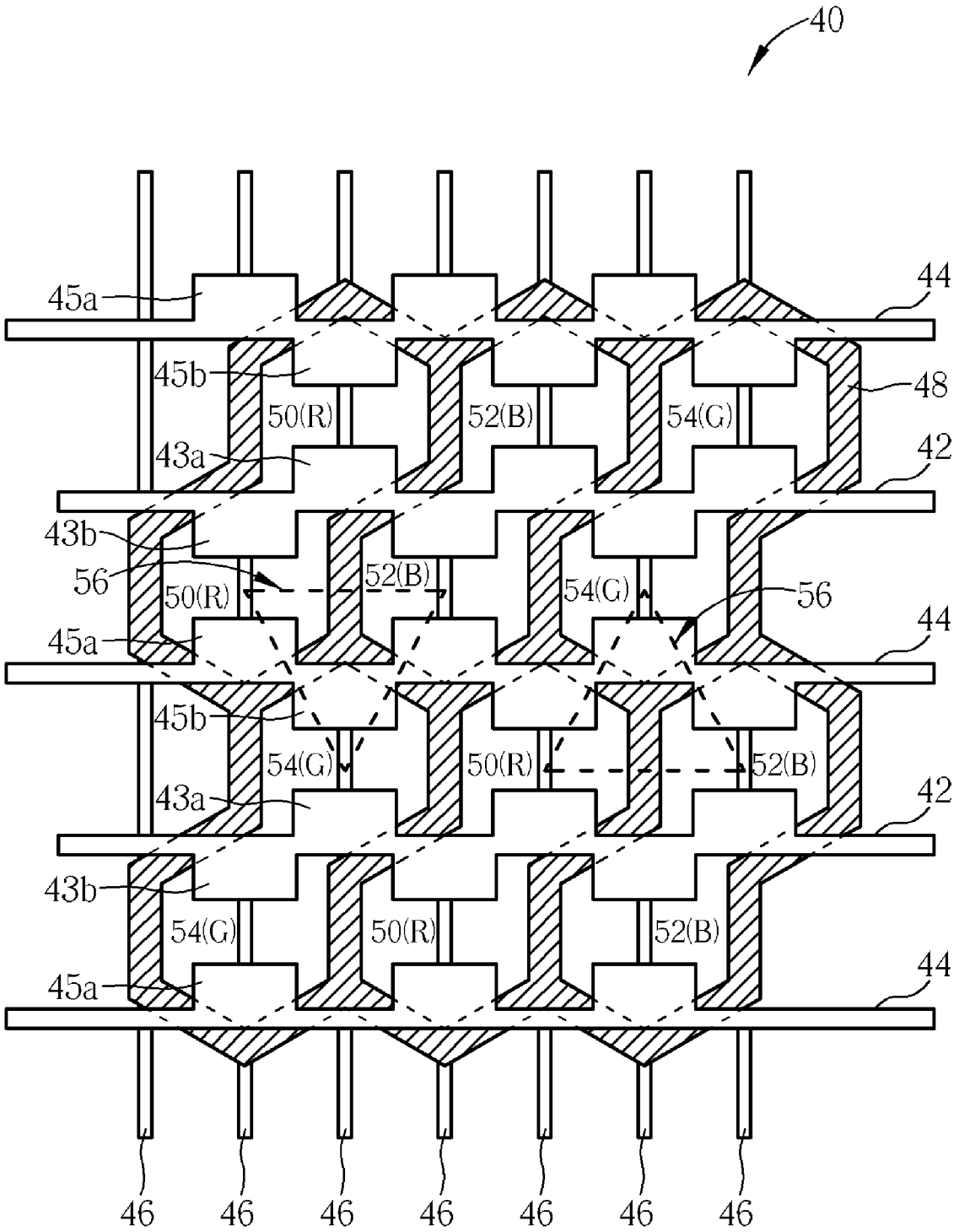
FIG. 6 and FIG. 7 are top views of a plasma display panel according to the second embodiment of the present invention.

As shown in FIG. 3 and FIG. 4, the PDP 40 further comprises a plurality of closed rib units 48 and a plurality of discharge spaces 49. The closed rib units 48 are formed over the address electrodes 46 and each of the closed rib units 48 comprises a structure of a decagonal ring. Additionally, each of the discharge spaces 49 is defined between the front substrate, the rear substrate, and each of the closed rib units 48. As shown in FIG. 3, each of the discharge spaces 49 has two sub-pixel units 50, two sub-pixel units 52, or two sub-pixel units 54. Each of the sub-pixel units 50, 52, and 54 comprises an X electrode 42, a Y electrode 44, and an address electrode 46 for igniting plasma in each of the sub-pixel units 50, 52, and 54. Each of the sub-pixel units 50 is a red sub-pixel unit R that is coated with red phosphors, each of the sub-pixel units 52 is a blue sub-pixel unit B that is coated with blue phosphors, and each of the sub-pixel units 54 is a green sub-pixel unit G that is coated with green phosphors. Furthermore, three sub-pixel units, which are arranged in a delta and include a red sub-pixel unit R, a blue sub-pixel unit B, and a green sub-pixel unit G, constitute a pixel unit 56. The sub-pixel units 50 in the same closed rib unit 48 respectively belong to two different pixel units 56, and similarly, the sub-pixel units 52 or 54 in the same closed rib unit 48 respectively belong to two different pixel units 56. Moreover, positions of the sub-pixel units 50, 52 and 54 can be varied with process requirements, and what is more, each of the closed rib units 48 can comprise a structure of a hexagonal ring (as shown in FIG. 6) or a quadrilateral ring.

Since the sub-pixel units 50, 52 and 54 have similar structures, the following description will take the sub-pixel units 50 as an example for explaining characteristics of the present invention. As described above, each of the closed rib units 48 includes two sub-pixel units 50, which communicate with each other. Accordingly, the space available to the discharge gas in each of the sub-pixel units 50 is equal to the space surrounded by each of the closed rib units 48. That is, the space available to the discharge gas in each sub-pixel unit 50 is equal to each discharge space 49, so that the space available to the discharge gas in each sub-pixel unit 50 is two times the space occupied by each sub-pixel unit 50. As a result, in contrast to the prior art, the space available to the discharge gas in each sub-pixel unit 50 is enlarged so that the discharge voltage for exciting and ionizing the discharge gas in each sub-pixel unit 50 is reduced, thus decreasing an operating voltage and power consumption of the PDP 40. Additionally, a size of each of the closed rib units 48 is much larger so that the closed rib units 48 can be manufactured more easily, thus enhancing a production yield of the closed rib units 48.

Figure 7:
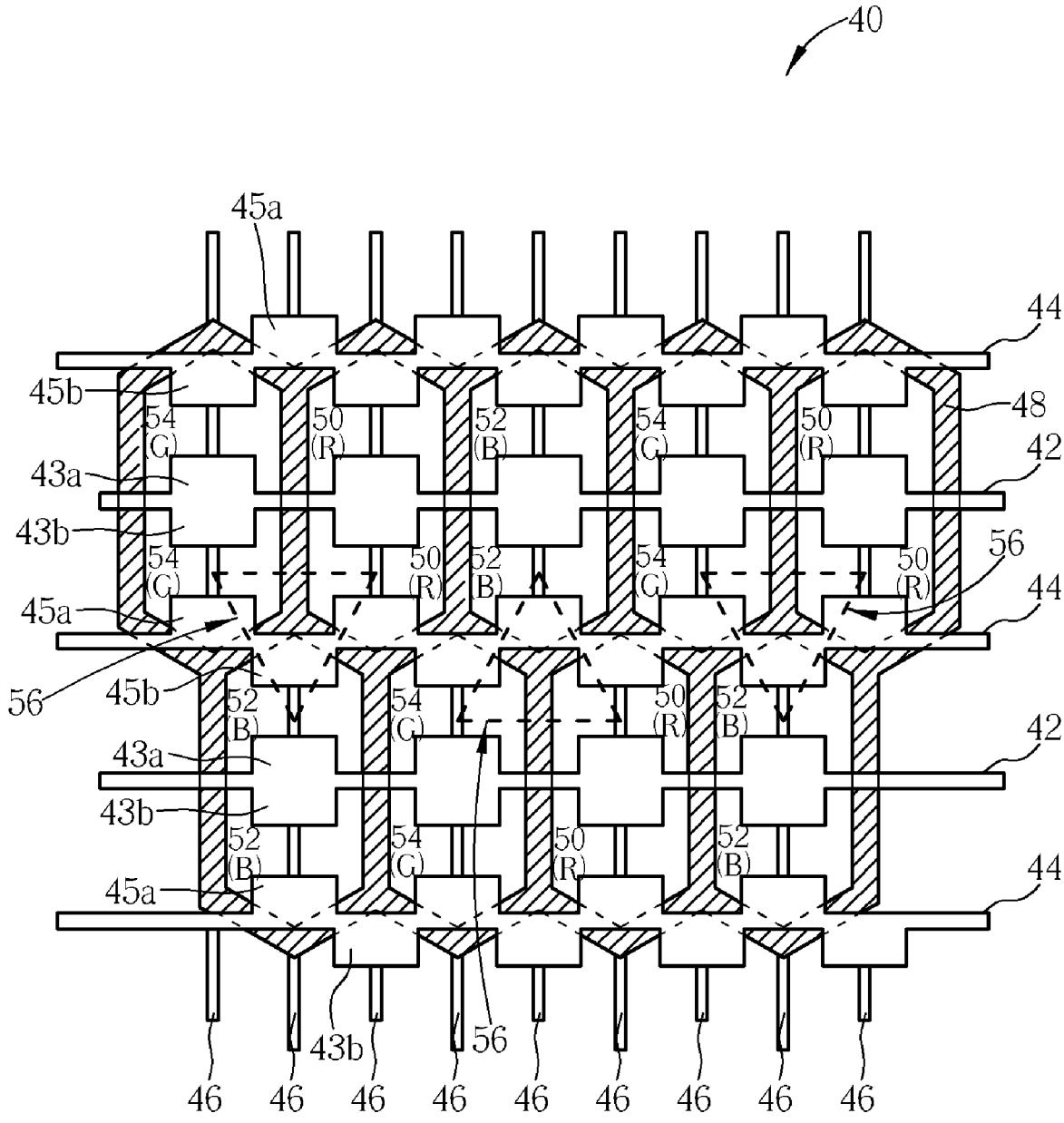

In addition, the structure of the PDP 40 is not limited to that shown in FIG. 3, and the following description will introduce other embodiments of the present invention. Please refer to FIG. 6 and FIG. 7. FIG. 6 and FIG. 7 are top views of a plasma display panel according to the second embodiment of the present invention. For convenience of explanation, the same elements of FIG. 3, FIG. 6, and FIG. 7 are indicated by the same symbols. As shown in FIG. 6, each of the X electrodes 42 includes a plurality of protruded portions 43*a* extending into the sub-pixel units 50, 52, and 54, and a plurality of protruded portions 43*b* extending into the sub-pixel units 50, 52, and 54. Likewise, each of the Y electrodes 44 includes a plurality of protruded portions 45*a* extending into the sub-pixel units 50, 52, and 54, and a plurality of protruded portions 45*b* extending into the sub-pixel units 50, 52, and 54. Additionally, the protruded portions 43*a* of each X electrode 42 are respectively opposite to their next protruded portions 45*b*, while the protruded portions 43*b* of each X electrode 42 are respectively opposite to their next protruded portions 45*a*. The protruded portions 43*a*, 43*b*, 45*a* and 45*b* are usually transparent electrodes consisting of indium tin oxide (ITO), and what is more, each of the closed rib units 48 also comprises a structure of a hexagonal ring (as shown in FIG. 7) or a quadrilateral ring.

Figure 8:
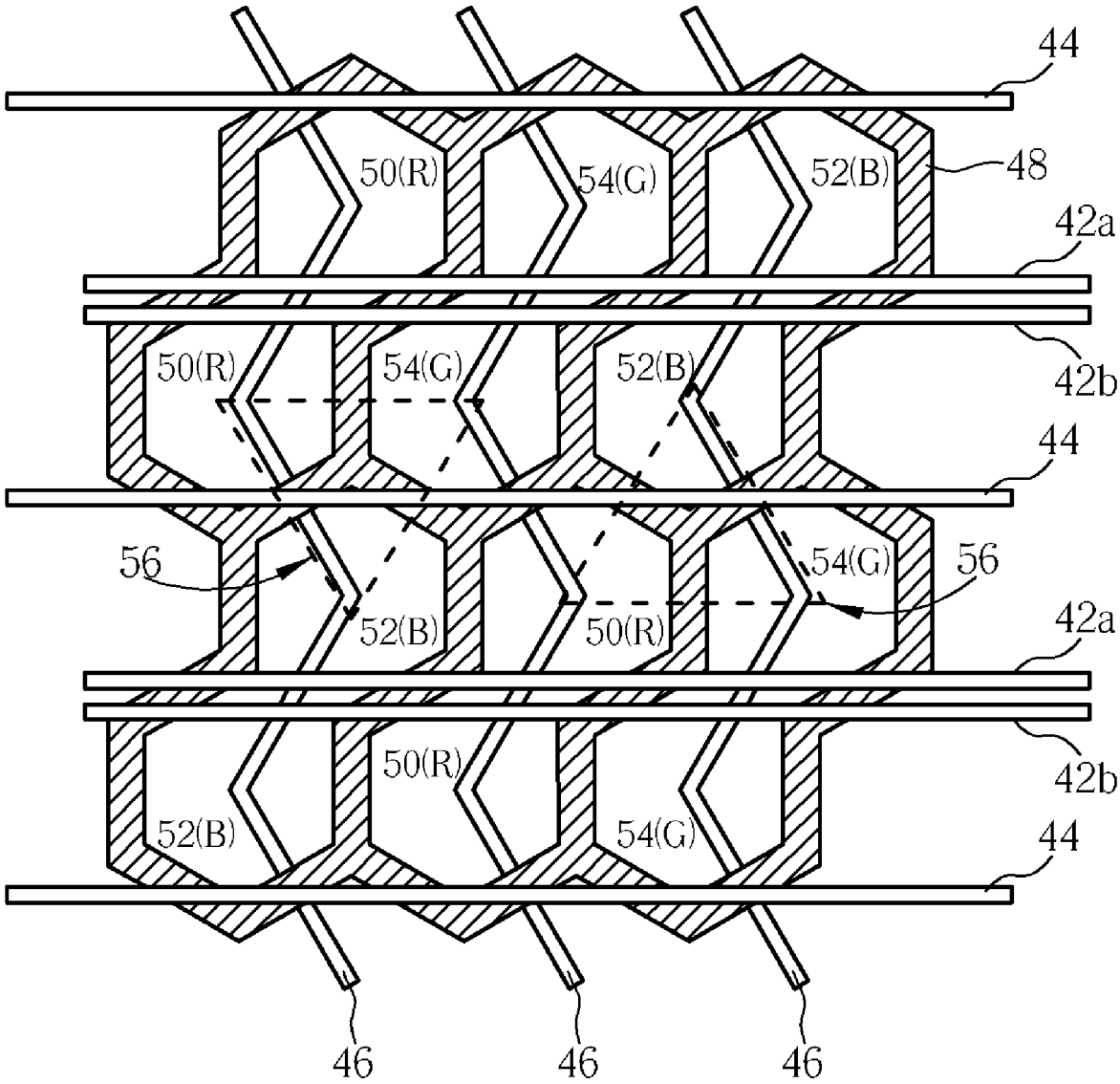
FIG. 8 to FIG. 13 are top views of a plasma display panel according to the third embodiment of the present invention.
Figure 9:
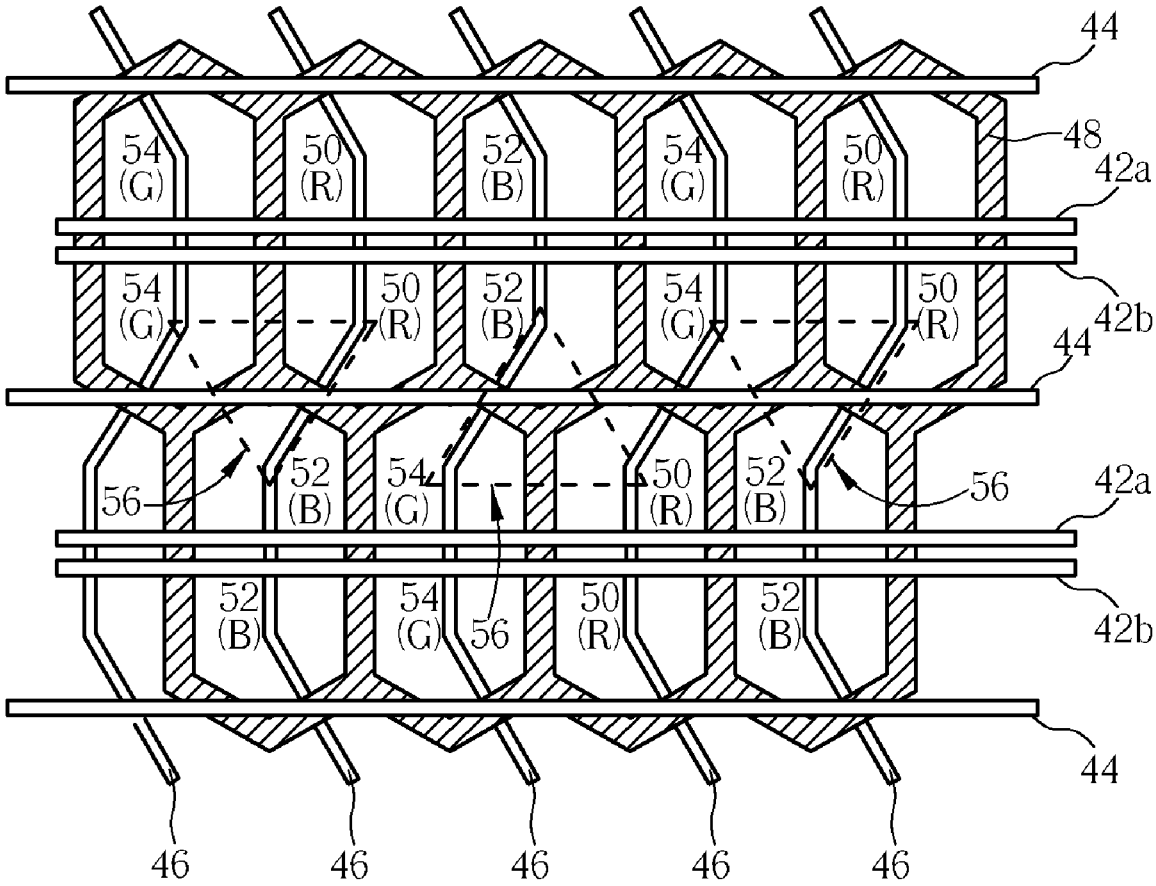
Figure 10:
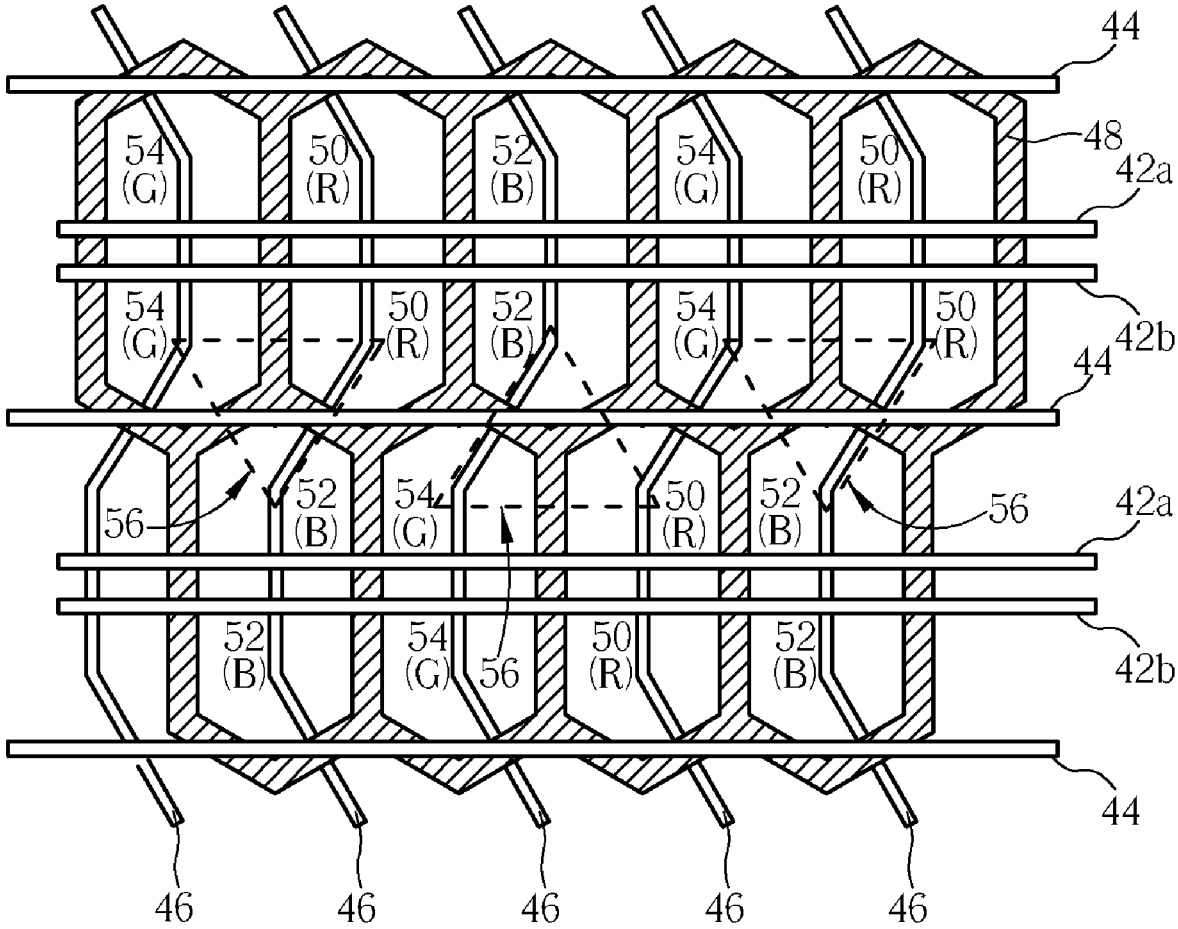
Figure 11:
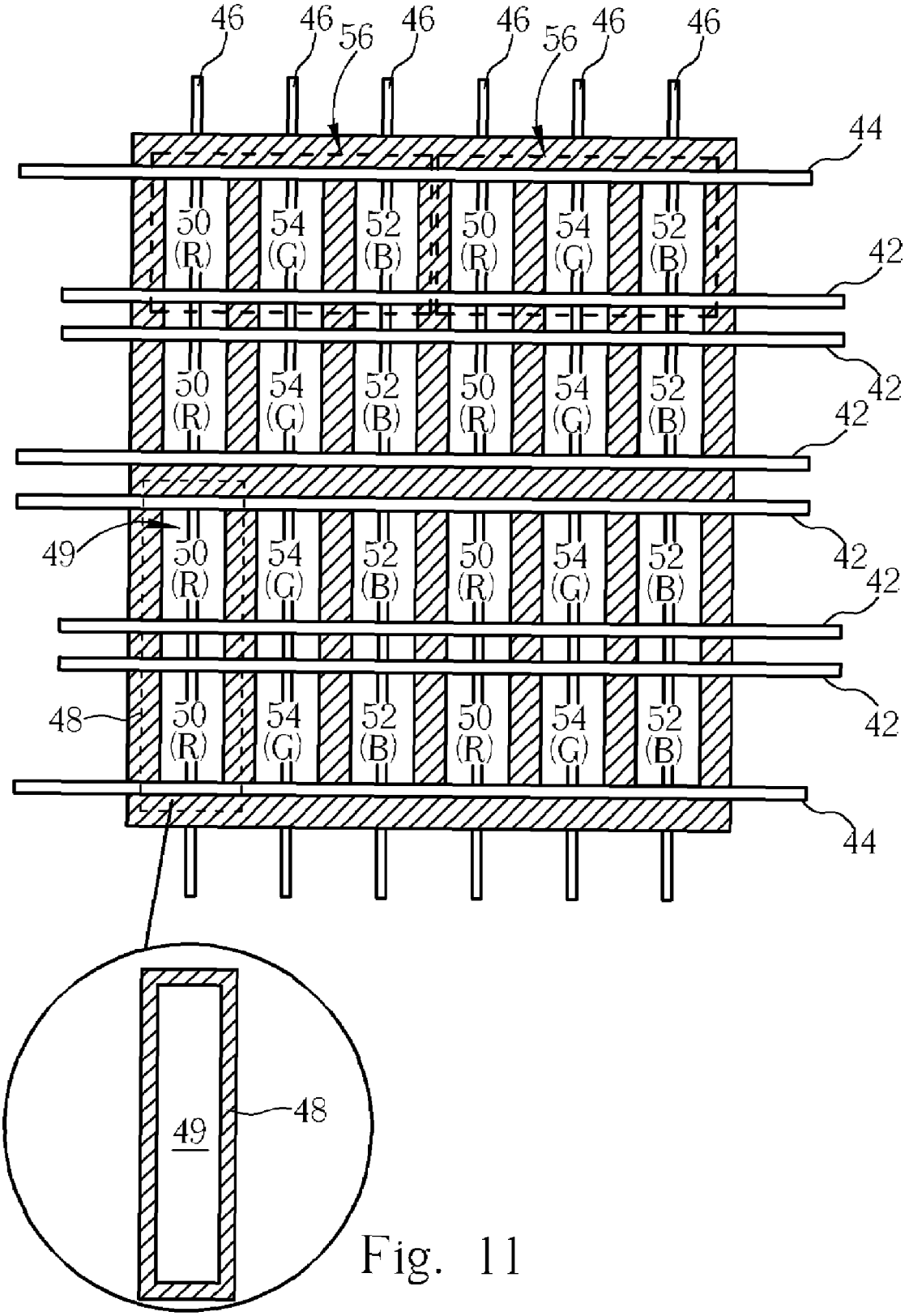
Figure 12:
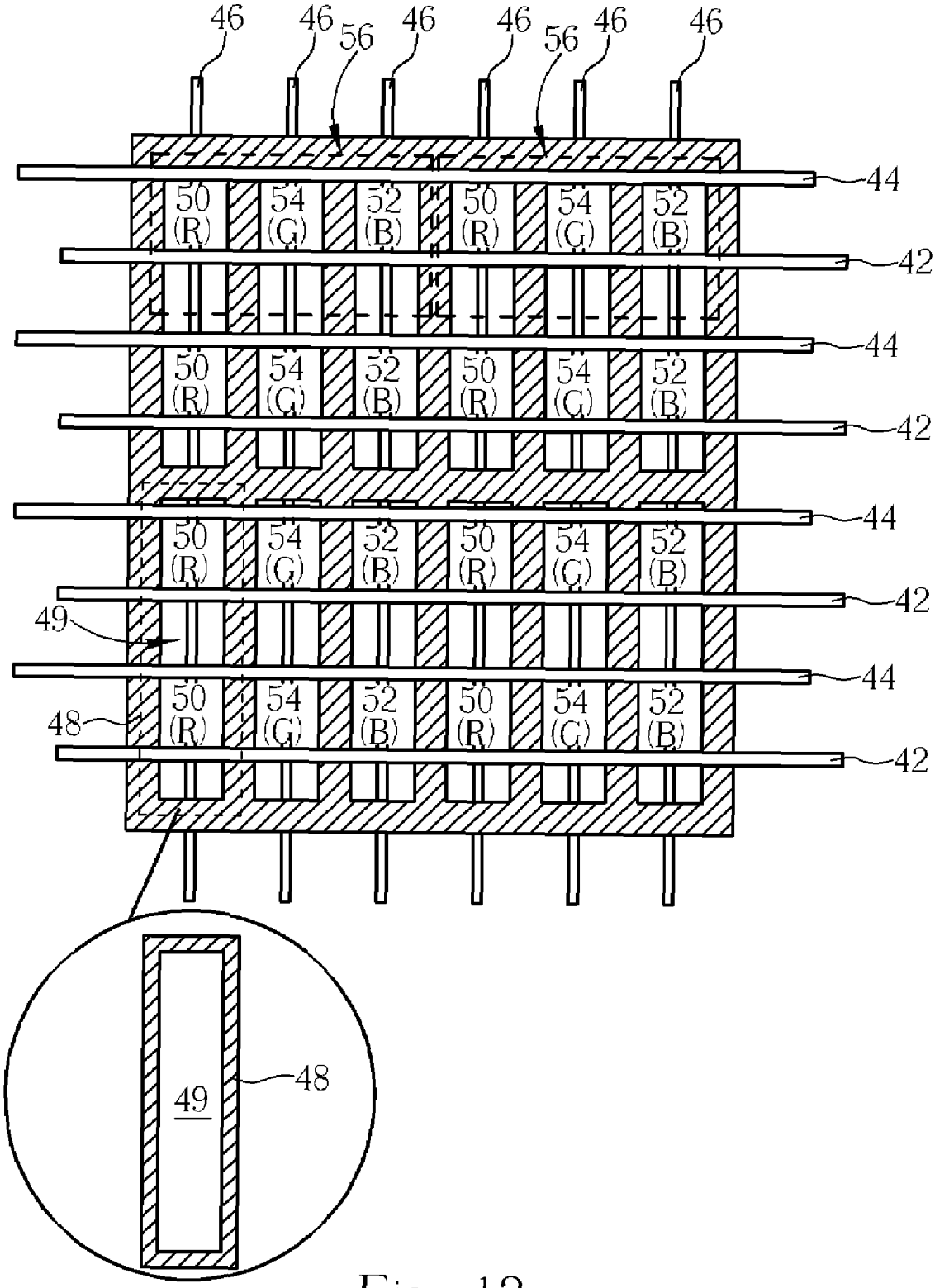
Figure 13:
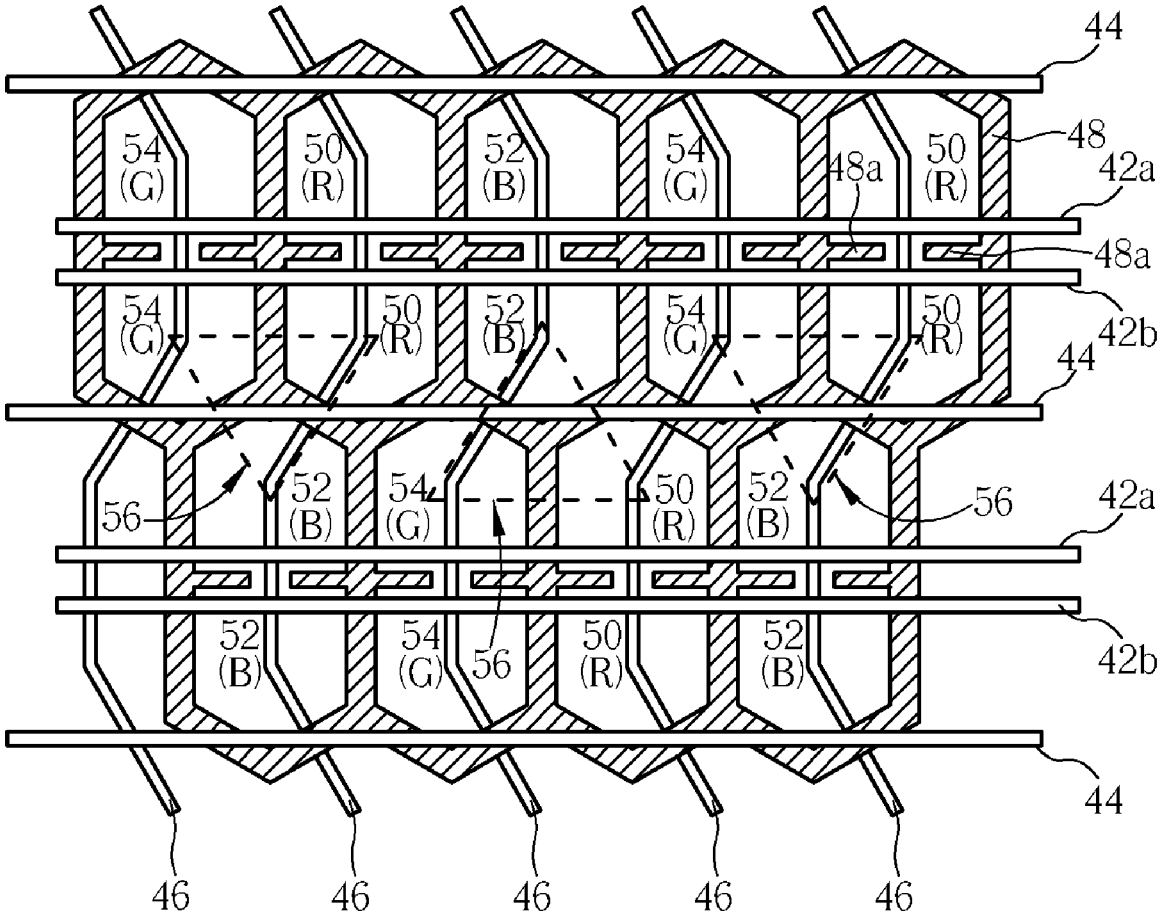

Please refer to FIG. 8 to FIG. 13. FIG. 8 to FIG. 13 are top views of a plasma display panel according to the third embodiment of the present invention. As shown in FIG. 8, the PDP 40 comprises a plurality of X electrodes 42*a* and 42*b*, a plurality of Y electrodes 44, and a plurality of address electrodes 46. The neighboring X electrodes 42*a* and 42*b* are positioned between two adjacent Y electrodes 44. Each of the address electrodes 46 passes through centers of the sub-pixel units 50, 52, or 54, and each address electrode 46 comprises a saw-like structure, a belt-like structure or the above-mentioned structure with various widths. Additionally, each of X electrodes 42*a*, 42*b* and Y electrodes 44 can have a plurality of protruded portions extending into the sub-pixel units 50, 52, and 54, as is described in the second embodiment of the present invention, and what is more, each of the closed rib units 48 also comprises a structure of a hexagonal ring (as shown in FIG. 9 and FIG. 10) or a quadrilateral ring (as shown in FIG. 11 and FIG. 12). As shown in FIG. 13, each of the closed rib units 48 further comprises two extended ribs 48*a* that are opposite to each other and are used to separate the sub-pixel units from each other in each of the closed rib units 48.

Figure 14:
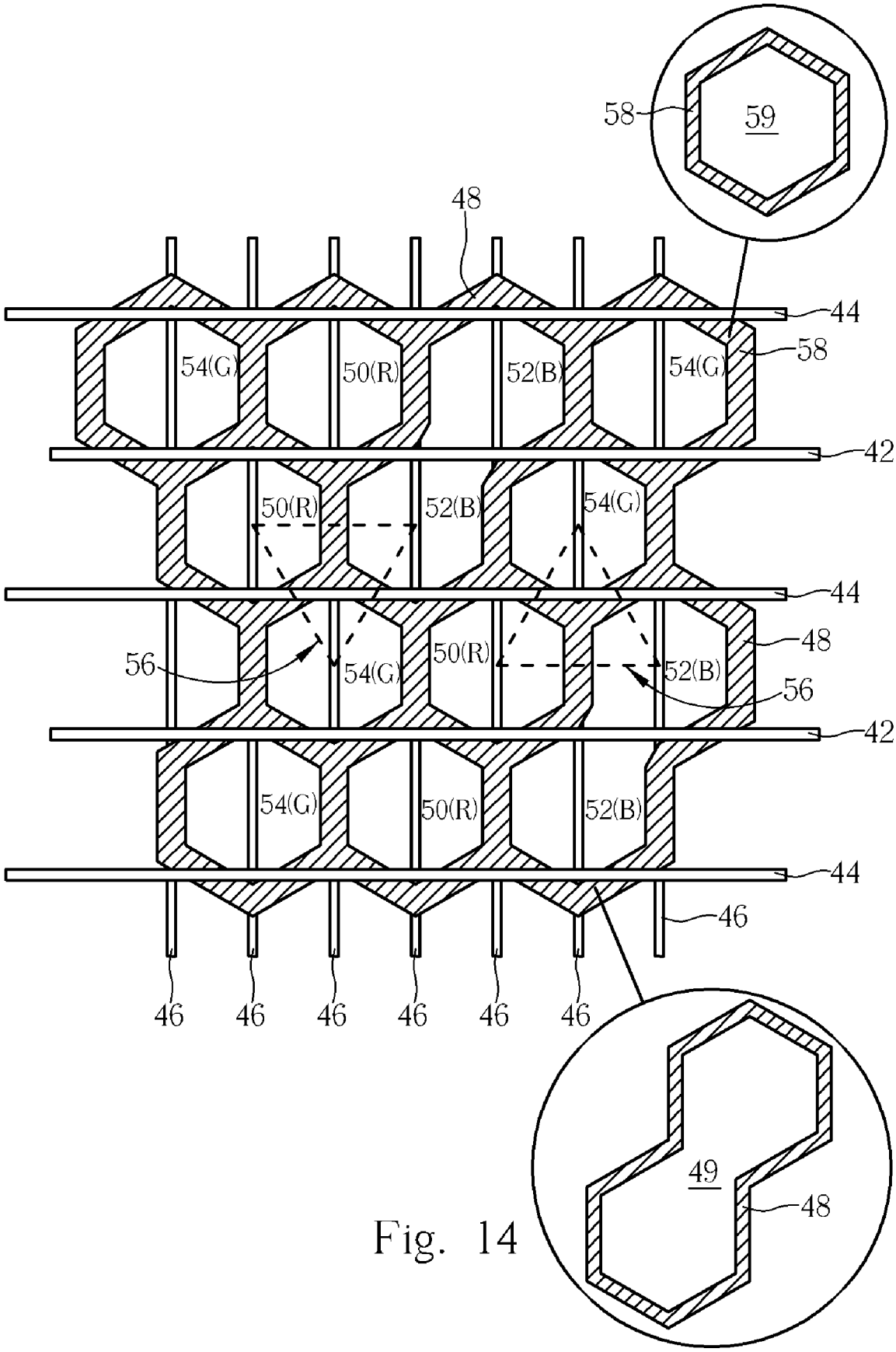
FIG. 14 and FIG. 15 are top views of a plasma display panel according to the fourth embodiment of the present invention.
Figure 15:
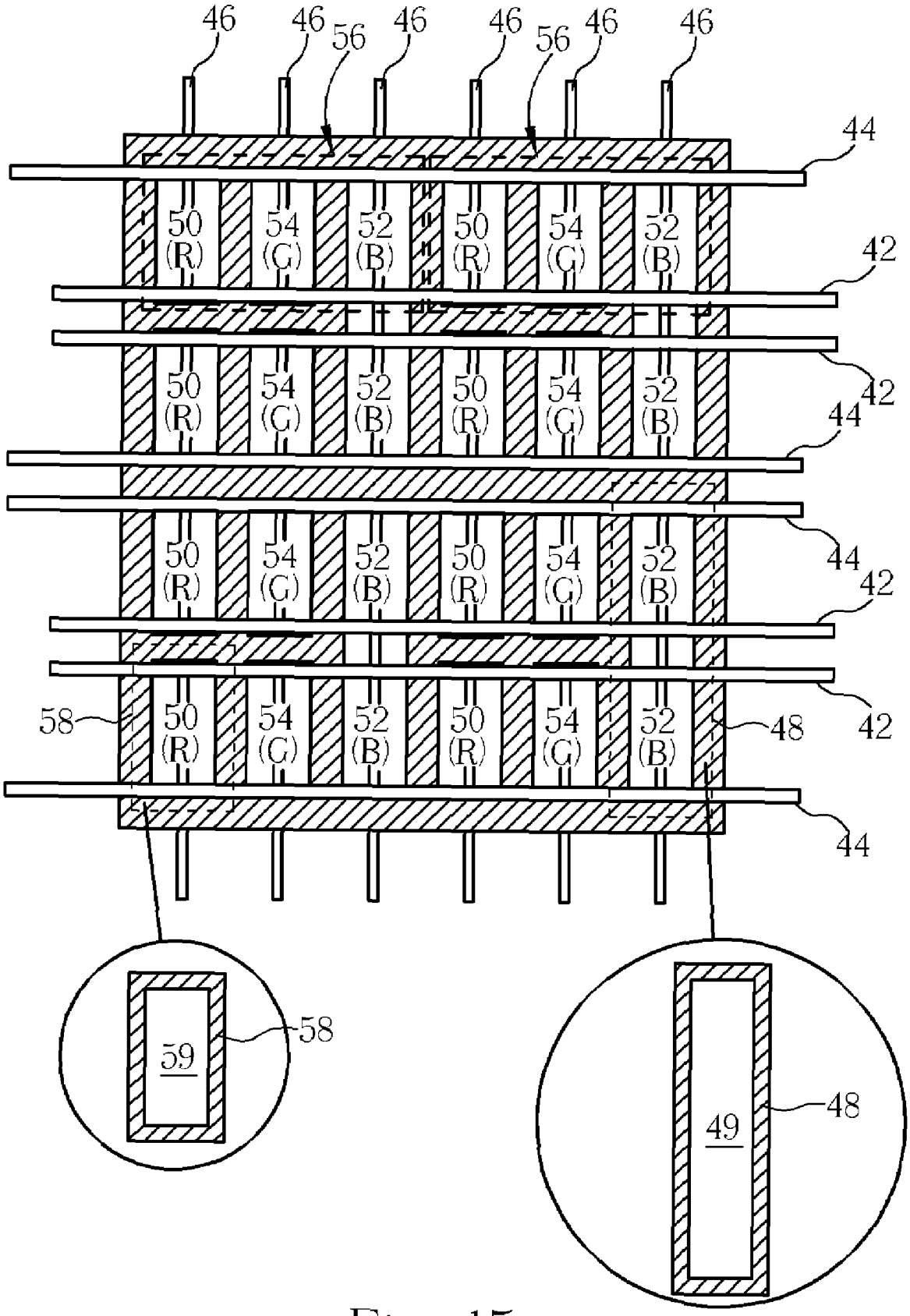

Please refer to FIG. 14 and FIG. 15. FIG. 14 and FIG. 15 are top views of a plasma display panel according to the fourth embodiment of the present invention. As shown in FIG. 14, the PDP 40 further comprises a plurality of closed rib units 48 and a plurality of closed rib units 58. Each of the closed rib units 48 comprises a structure of a decagonal ring and each of the closed rib units 58 comprises a structure of a hexagonal ring, so that a region surrounded by each closed rib unit 48 is larger than that surrounded by each closed rib unit 58. Additionally, the PDP 40 further includes a plurality of discharge spaces 49 and a plurality of discharge spaces 59. Each of discharge spaces 49 includes two sub-pixel units 52, and is defined between the front substrate, the rear substrate, and each of the closed rib units 48. Each of discharge spaces 59 includes a sub-pixel unit 50 or a sub-pixel unit 54, and each of discharge spaces 59 is defined between the front substrate, the rear substrate, and each of the closed rib units 58. As mentioned above, the discharge voltage of the discharge gas varies with the space available to the discharge gas, so that the discharge voltage of the sub-pixel units 52 in each closed rib unit 48 is therefore smaller than that of the sub-pixel units 50 (or 54) in each closed rib unit 58, for each closed rib unit 48 is larger than each closed rib unit 58.

As is known to those skilled in the art, the discharge voltage of the discharge gas also varies with different phosphors. That is, the discharge voltage of the discharge gas in the red sub-pixel unit R is different from that in the blue sub-pixel unit B or in the green sub-pixel unit G. Since the present embodiment provides two kinds of closed rib units 48 and 58, the sub-pixel units with a higher discharge voltage can be arranged in the closed rib units 48 and the sub-pixel units with a lower discharge voltage can be arranged in the closed rib units 58 for making the discharge voltages of all of the sub-pixel units approximately identical. Additionally, an illuminant area surrounded by the closed rib units 48 is larger than that surrounded by the closed rib units 58, so that the present embodiment can adjust a color temperature of the PDP 40 through modifying illuminant areas of sub-pixel units. Furthermore, each of the closed rib units 48 and 58 also comprises a structure of a quadrilateral ring (as shown in FIG. 15). Each of X electrodes 42 and Y electrodes 44 can have a plurality of protruded portions extending into the sub-pixel units 50, 52, and 54, as is described in the second embodiment of the present invention.

Figure 16:
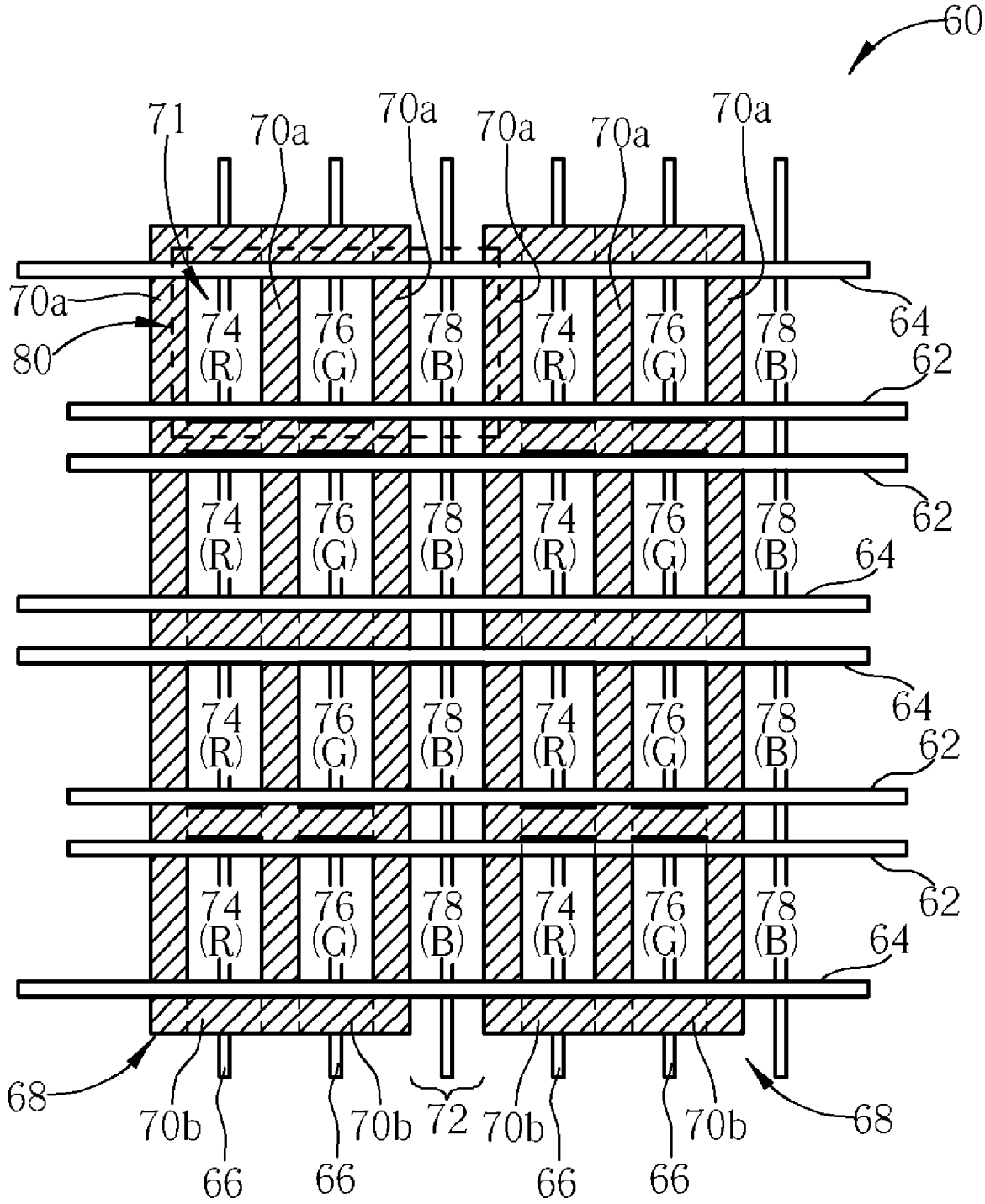
FIG. 16 is a top view of a plasma display panel according to the fifth embodiment of the present invention.

Please refer to FIG. 16. FIG. 16 is a top view of a plasma display panel according to the fifth embodiment of the present invention. As shown in FIG. 16, a PDP 60 comprises a front substrate (not shown), a rear substrate (not shown) parallel and opposite to the front substrate, and a discharge gas (not shown) filled between the front substrate and the rear substrate. Additionally, the PDP 60 further comprises a plurality of X electrodes 62 formed on the front substrate, a plurality of Y electrodes 64 formed on the front substrate, and a plurality of address electrodes 66 formed on the rear substrate. The X electrodes 62 are arranged in parallel with and interlaced with the Y electrodes 64, and the address electrodes 66 are perpendicular to the X electrodes 62 and the Y electrodes 64.

As shown in FIG. 16, the PDP 60 further comprises a plurality of waffle-structured ribs 68 formed over the address electrodes 66, and a plurality of discharge spaces 72. Each of the discharge spaces 72 is defined between the front substrate, the rear substrate, and two adjacent waffle-structured ribs 68, and each of the discharge spaces 72 includes a plurality of sub-pixel units 78, each of which is a blue sub-pixel unit B. In addition, each of the waffle-structured ribs 68 includes three ribs 70*a* that are parallel to the address electrodes 66, and a plurality of ribs 70*b* that are connected between the ribs 70*a* and are parallel to the X electrodes 62 and the Y electrodes 64. Furthermore, the PDP 60 further comprises a plurality of discharge spaces 71, each of which is defined between the front substrate, the rear substrate, two adjacent ribs 70*a*, and two adjacent ribs 70*b*. Each discharge space 71 comprises one sub-pixel unit 74 or one sub-pixel unit 76, and each of the sub-pixel units 74 and 76 is a red sub-pixel unit R or a green sub-pixel unit G. As shown in FIG. 16, three sub-pixel units, which are arranged in a line and include a red sub-pixel unit R, a green sub-pixel unit G, and a blue sub-pixel unit B, constitute a pixel unit 80. Moreover, positions of the sub-pixel units 74, 76 and 78 can vary with process requirements, and what is more, each of X electrodes 62 and Y electrodes 64 can have a plurality of protruded portions extending into the sub-pixel units 74, 76, and 78, as is described in the second embodiment of the present invention.

Figure 17:
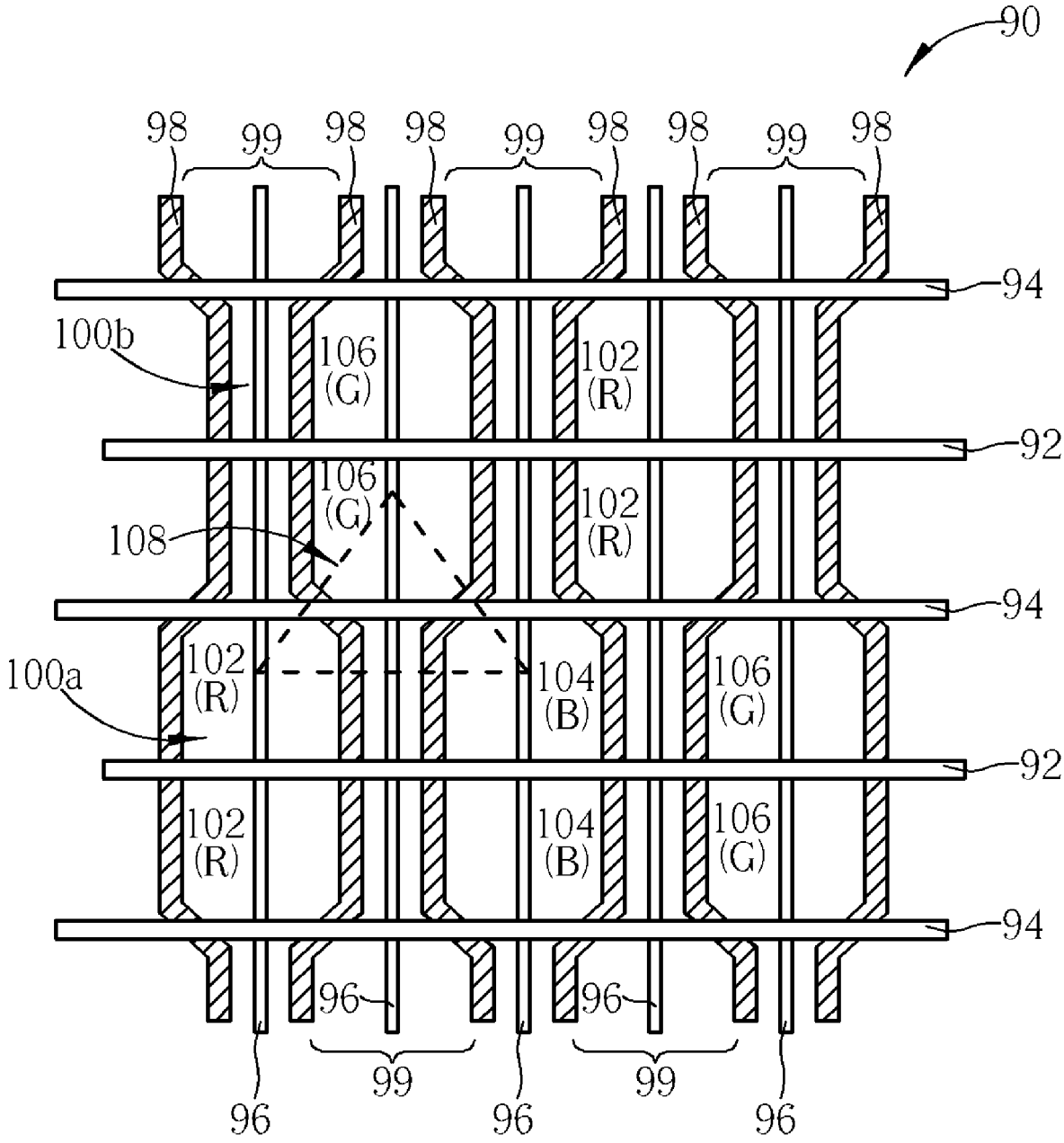
FIG. 17 is a top view of a plasma display panel according to the sixth embodiment of the present invention.

Please refer to FIG. 17. FIG. 17 is a top view of a plasma display panel according to the sixth embodiment of the present invention. As shown in FIG. 17, a PDP 90 comprises a front substrate (not shown), a rear substrate (not shown) parallel and opposite to the front substrate, and a discharge gas (not shown) filled between the front substrate and the rear substrate. Additionally, the PDP 90 further comprises a plurality of X electrodes 92 formed on the front substrate, a plurality of Y electrodes 94 formed on the front substrate, and a plurality of address electrodes 96 formed on the rear substrate. The X electrodes 92 are arranged in parallel with and interlaced with the Y electrodes 94, and the address electrodes 96 are perpendicular to the X electrodes 92 and the Y electrodes 94.

As shown in FIG. 17, the PDP 90 further comprises a plurality of ribs 98 formed on the rear substrate, and a plurality of discharge spaces 99 defined between the front substrate, the rear substrate, and two adjacent ribs 98. Each of the discharge spaces 99 comprises a plurality of regions 100*a* and regions 100*b*, each of the regions 100*a* being positioned between two adjacent regions 100*b* and being larger than each of the regions 100*b*. Additionally, each of the regions 100*a* includes two sub-pixel units 102, two sub-pixel units 104, or two sub-pixel units 106. Each of the sub-pixel units 102, 104, and 106 is a red sub-pixel unit R, a blue sub-pixel unit B, or a green sub-pixel unit G. As shown in FIG. 16, three sub-pixel units, which are arranged in a delta and include a red sub-pixel unit R, a green sub-pixel unit G, and a blue sub-pixel unit B, constitute a pixel unit 108. Furthermore, positions of the sub-pixel units 102, 104 and 106 can be changed according to process requirements, and each of X electrodes 92 and Y electrodes 94 can have a plurality of protruded portions extending into the sub-pixel units 102, 104, and 106, as is described in the second embodiment of the present invention.

Figure 1:
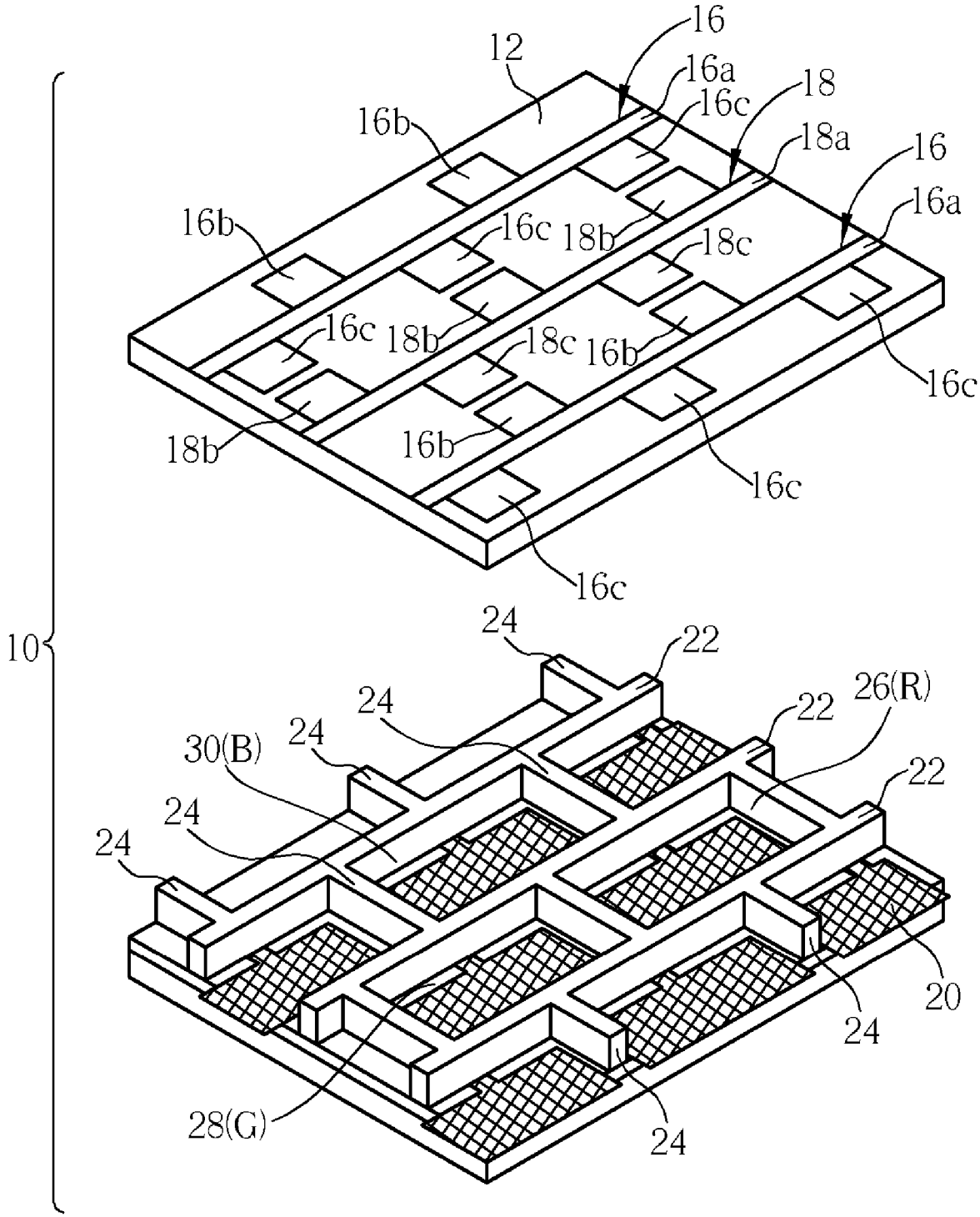
Fig. 1 Prior art
FIG. 1 is an exploded diagram of a plasma display panel disclosed in U.S. Pat. No. 6,373,195B1.
Figure 2:
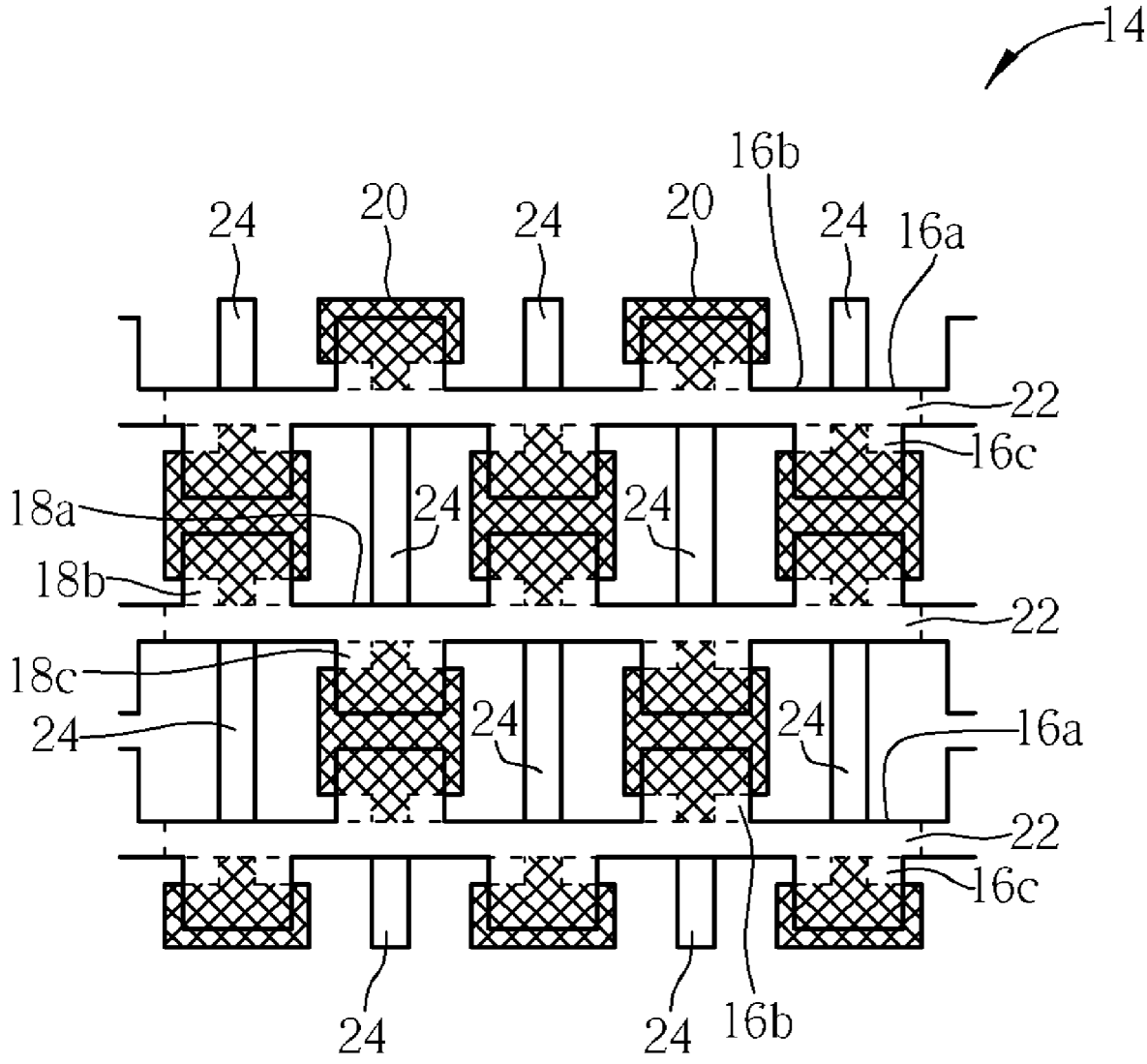
Fig. 2 Prior art
FIG. 2 is a top view of the plasma display panel shown in FIG. 1.

It should be noticed that the address electrodes 46, 66, and 96 could be designed as the address electrodes 20 shown in FIG. 1.

In comparison with the prior art, the present invention provides a plurality of closed rib units 48, each of which comprises two sub-pixel units, so that the space available to the discharge gas in each sub-pixel unit is increased, thereby reducing the discharge voltage and brightness of the discharge gas and further decreasing the operating voltage and power consumption of the PDP 40. Additionally, a size of each of the closed rib units 48 is much larger so that the closed rib units 48 can be manufactured more easily, thus enhancing a production yield of the closed rib units 48. Furthermore, since the present invention provides two kinds of closed rib units 48 and 58, the present invention can pair up closed rib units 48, 58 with red, blue, and green phosphors according to the discharge characteristic of the discharge gas in red, blue, and green phosphors. Therefore, the sub-pixel units with identical discharge voltages can be designed. Moreover, an illuminant area of each closed rib unit 48 is larger than that of each closed rib unit 58, so that a color temperature of the PDP 40 can be adjusted through modifying illuminant areas.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A plasma display panel comprising:

a plurality of bar-like ribs positioned on a rear substrate and extending along a first direction;

a plurality of first discharge spaces respectively having a plurality of first regions and a plurality of second regions defined between a front substrate, the rear substrate, and two of the adjacent bar-like ribs, each of the first regions comprising two sub-pixel units; and a plurality of first electrodes respectively across centers of the first regions and the second regions, the first electrode equally dividing the first regions into the two sub-pixel units.

2. The plasma display panel of claim 1, wherein the first regions and the second regions are interlaced.

3. The plasma display panel of claim 1, wherein the first regions are larger than the second regions.

4. The plasma display panel of claim 1, wherein the sub-pixel units comprise a plurality of red sub-pixel units, blue sub-pixel units, and green sub-pixel units, wherein one of the red sub-pixel units, one of the blue sub-pixel units, and one of the green sub-pixel units together constitute a pixel unit.

5. The plasma display panel of claim 1, wherein the sub-pixel units of each pixel unit are arranged in a delta.

6. The plasma display panel of claim 1 further comprising a second electrode interlacing with the first electrode.

7. The plasma display panel of claim 6, wherein the first electrode and the second electrode of each of the sub-pixel units comprise a first protruded portion and a second protruded portion respectively, the first protruded portion being opposite to the second protruded portion for igniting plasma in each of the sub-pixel units.

8. The plasma display panel of claim 6 further comprising an addressing electrode opposite to the first electrode and the second electrode for igniting plasma in each of the sub-pixel units.

* * * * *